United States Patent [19]

Matsumoto

[11] Patent Number: 4,931,127

[45] Date of Patent: Jun. 5, 1990

[54] LABELLING SYSTEM

[75] Inventor: Mitsuo Matsumoto, Hyogo, Japan

[73] Assignee: Kanzaki Seishi Company, Tokyo, Japan

[21] Appl. No.: 297,942

[22] Filed: Jan. 17, 1989

[30] Foreign Application Priority Data

Feb. 8, 1988 [JP] Japan ..... 62-27035
Feb. 8, 1988 [JP] Japan ..... 62-27036
Mar. 25, 1988 [JP] Japan ..... 62-72406

[51] Int. Cl.[5] ..... B65C 9/18

[52] U.S. Cl. ..... 156/361; 156/363; 156/542; 156/552

[58] Field of Search ..... 156/540–542, 156/361–363, 552

[56] References Cited

U.S. PATENT DOCUMENTS 4,547,250 10/1985 Murayama ..... 156/542 X

*Primary Examiner*—David Simmons
*Attorney, Agent, or Firm*—Schweitzer & Cornman

[57] ABSTRACT

A labelling system for automatically applying an adhesive label, in sequence, onto a post card carrier strip, which comprises a paper conveying device for sequentially feeding the continuous label carrier strip to a predetermined position of applying the labels, and a label pasting device for applying the labels onto the post cards at that position.

16 Claims, 10 Drawing Sheets

LABELLING SYSTEM

FIELD OF THE INVENTION

The present invention concerns a labelling apparatus which automatically and continuously pastes labels indicating a message, an advertisement, etc. to an object material consisting of a continuous band-shaped sheet intended to form post cards, advertising documents, etc.

BACKGROUND OF THE INVENTION

In recent years, fast communication with customers, etc. has become indispensable for business activities in financial, health, credit, mass sale industries as well as in government and municipal offices, and there are now growing needs and expectations for labor saving in communications.

In such communication work, one cannot effectively handle post cards, which are one of the communication means if one writes messages on them manually as one did in the past. Moreover, direct printing on a post card is unsuitable for indication of messages different from one another.

There was no choice but to rely on manual work for most of the communication activity of this type in the past, because no system was available that was capable of fastening labels automatically and rapidly to a large quantity of object material such as post cards.

DESCRIPTION OF THE INVENTION

The present invention aims at saving labor in communication work by using labels indicating written messages of different contents or other communication material such as common advertisements, and automatically attaching them to object materials, such as post cards. Any reference hereafter to post cards is intended also to encompass any other suitable object material to which a label can be attached.

Therefore, the first purpose of the present invention is to provide an automatic labelling system which sticks labels automatically and rapidly to a large quantity of items to be provided with labels (hereinafter referred to as "object materials") such as continuous sheet of post cards.

It is important in this kind of automatic system that it provide ease of replacement or setting of labels to be pasted to the object material, since in many cases the labels are different from one another in content of messages or placement.

Therefore, the second purpose of the present invention is to enable easy placement and attachment of labels by the automatic system.

BRIEF DESCRIPTION OF THE DRAWING

Other purposes and objectives of the present invention will become clear in the course of the following detailed description of the invention with reference being had to the drawing, wherein:

FIG. 12 is a longitudinal schematic sectional view of the other embodiment.

FIG. 13 is a schematic side view of the transmission system of the other embodiment.

FIG. 14 is a plan view of the illustration in FIG. 13.

FIG. 15 is a longitudinal schematic sectional view of said other embodiment, illustrating the conveying route of the label carrier strip at the time of attaching.

DETAILED DESCRIPTION OF PREFERRED EMBODIMENTS

Figure 1:
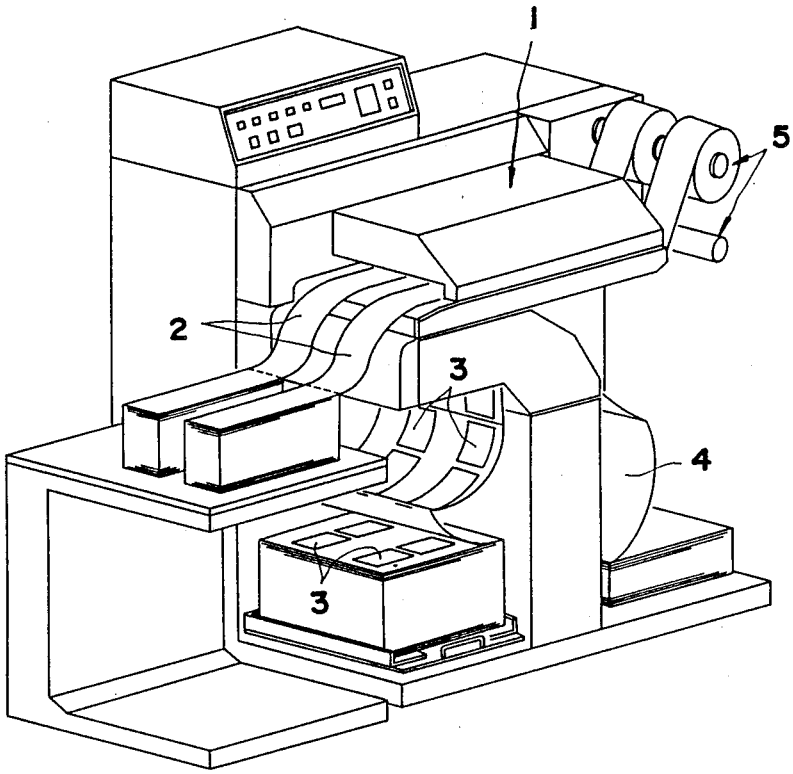
FIG. 1 is a perspective view of an embodiment the labelling system of the present invention.

FIG. 1 indicates a an embodiment of a labelling machine provided with the labelling apparatus 1 of the present invention constituted in such a way that it pastes the labels 3 that are temporarily and detachably attached to one side of a label carrier strip to a specified position of a post card attached to a carrier strip 4 which is the object material for labelling, and falls of the label carrier strip 2 deprived of labels by means of winder 5.

Figure 2:
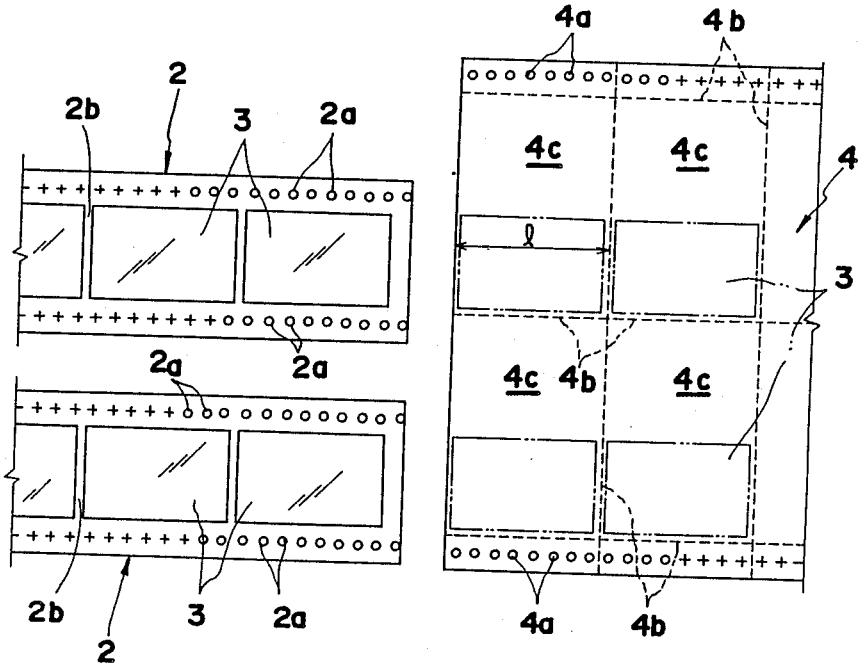
FIG. 2 is a plan view indicating a band-shaped carrier strip with labels thereon, and a continuous carrier strip for post cards.
Figure 3:
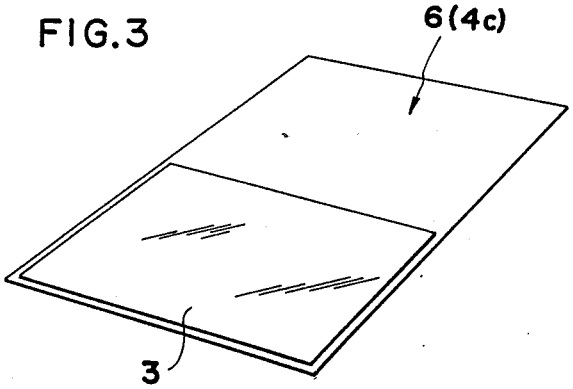
FIG. 3 is a perspective view of a post card provided with a label.

As shown in FIG. 2, the label carrier strip 2 is provided with feed sprocket holes **2*a* at regular intervals on both side edges in the longitudinal direction and with labels 3 pasted on one face in a detachable way with a preselected spacing 2*b* in the longitudinal direction between the labels. The post card carrier strip 4 is provided with feed sprocket holes 4*a* along the longitudinal direction on both side edges at the same intervals as those of the said feed holes 2*a*, and forms post card holding areas 4*c* in two rows in the direction of width, with the perforation 4*b* provided for separation. The labelling machine shown in FIG. 1 is designed to fit the labels 3 peeled off rom the label carrier strip 2 at the specified position in each post card area 4*c* as indicated with notional lines by using two sheets of label carrier strips 2 arranged in correspondence to each row of the post card area 4*c* in the said post card carrier strip 4 and produce post cards 6 provided with a label 3 pasted at the specified position on one face as shown in FIG. 3 by cutting the post card carrier strips 4 provided with labels at the perforation 4*b* to separate each post card area 4C**.

Figure 4:
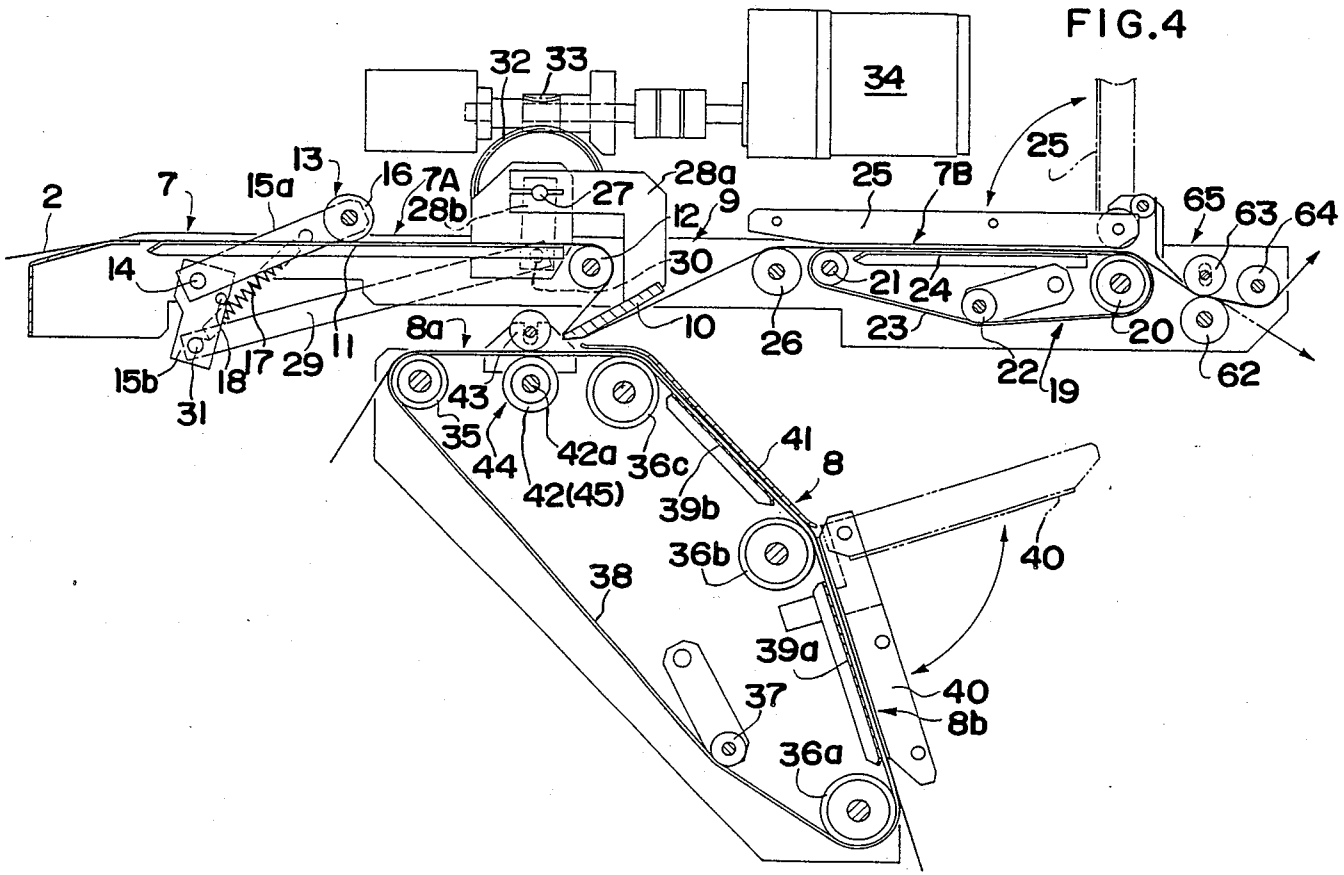
FIG. 4 is a longitudinal sectional view of an embodiment of the labelling system.

The labelling machine 1 is provided, as indicated in FIG. 4, with a straight and horizontal label conveying route 7 for label carrier strip and a post card conveying route 8 for post card carrier strip provided under that label conveying route 7. The said label conveying route 7 for carrier strip is arranged in two parallel rows for the purpose of transporting the two sheets of the label carrier strip 2 in parallel. Furthermore, each label conveying route 7 comprise an upstream side label conveying route portion 7B disposed in series across a vertical opening 9 position between them. A turning guide 10 for the label carrier strip which moves the said opening 9 vertically is disposed over the said two (left and right) rows of label conveying route 7 for the label carrier strip. The said upstream label conveying route portion 7A comprises a fixed guide plate 11 forming a guide face for conveyance of label carrier strip and a guide roller laid at the end on the side of the opening 9 and, moreover, is provided with a braking device 13 which pinches the label carrier strip 2 together with the said fixed guide plate 11. This braking device 13 includes a breaking roller 16 supported by a shaft rotatable between the top ends of a pair of (left and right) first mobile arms 15*a* held on an axis in a vertically swingable manner by a horizontal supporting shaft 14 under the said fixed guide plate 11, and is provided with a power spring 17 between the second mobile arm 15*b* held on axis in longitudinally swingable way by the said horizontal supporting shaft 14 and the said first mobile arm 15*a* so to push the said first mobile arms 15*a* against the stopper pin 18 of the second mobile arm 15*b*.

The said downstream side label conveying device 19 for carrier strip for labels 7B is provided with a conveying device 19 for carrier strip for labels 7B is provided with a conveying device 19 consists of a pair of (left and right) chains with feed claws 23 (feed claws are not indicated in the drawing), which is stretched between a driving toothed sprocket wheel 20 and a driven toothed sprocket wheel 21 and given a proper tension by a mobile toothed sprocket wheel 22 for tensioner, a fixed guide plate 24 and a freely rising and falling presser guide 25. A guide roller 26 is disposed close to the said opening 9 side end of this conveying device 19.

The said turning guide 10 for label carrier strip is mounted horizontally in the tranversal direction at the tip of the vertically swingable first mobile arm 28*a* one end of which is fixed to a horizontal driving shaft 27 disposed inthe transversal direction, and the second mobile arm 15*b* which moves up and down the said braking device 13 are linked with each other through an interlocking link 29. 30 and 31 are connected pins between the interlocking line 29 and the mobile arms 28*b*, 15*b*, and one end of the said power spring 17 is moored to the connecting pin 31 for connection with the mobile arm 15*b*. A worm wheel 32 is fixed to the said driving shaft 27, and the worm gear 33 occluding with this worm wheel is designed to be rotatable in both normal and reverse directions as desired by means of a motor 34.

Therefore, if the said motor 34 rotates the driving shaft 27 in the normal direction (clockwise direction in FIG. 4) through the worm gear 33 and the worm wheel 32, the turning guide 10 turns in the same direction through the first mobil arm 28*a* and moves up obliquely to the inside (lower part) of the label conveying route 7 for label carrier strip via the opening 9 to come to the position for peeling off a label. At the same time, the second mobile arm 15*b* for moving up and down the braking device 13 turns in the same direction through the second mobile arm 28*b* and the interlocking link 29 and, in keeping with this action, the first mobile arm 15*a* also turns in the same direction through the power spring 17, causing the braking roller 16 to touch the upper face of the fixed guide plate 11 of the upstream side label conveying route portion 7A. At this time, the second mobile arm 15*b* turns for a little while even after the braking roller 16 touched the upper face of the fixed guide plate 11 and, of that reason, the first mobile arm 15*a* is detached from the stopper pin 18 of the second mobile arm 15*b* and the braking roller 16 is pressed against the upper face of the fixed guide plate 11 with the pressing force of the power spring 17.

The said post card conveying route 8 is constituted by a pair of (left and right) chains with feed claws 38 (feed claws are note indicated int he drawing) stretched on a driving toothed sprocket wheel 35 and a plural number of driven toothed wheels 36*a*–36*c* in a way to form horizontal route portion 8*a* which is adjacent to the end of the turning guide 10, which has moved to the label peeling position, and the conveying direction of which is opposite to that of the conveying route 7 for label carrier strip an a mounting route portion 8*b* which is connected to the starting end position of that horizontal route portion 8*a*, and given a proper tension by a mobile toothed sprocket wheel for tensioner 37, fixed guide plates 39*a*, 39*b*, a freely rising and falling pressure guide 40 and a fixed presser guide 41. Moreover, this post card conveying route 8 is provided with a labelling device 44 consisting of a driving roller 42 and a presser roller 43, on the downstream side of the direction of conveyance int he horizontal route 8*a* from the turning guide 10 which has moved to the label peeling position as mentioned earlier. THe said driving roller 42 is driven at the same peripheral speed as the moving speed of the said chain 38 with the occlusion of a toothed wheel 45 fixed to its driving shaft 42*a* with that chain 38.

Close to the terminal end of the conveying route 7 for the label carrier strip, there is a feed device 65 for the label carrier strip consisting of a driving roller 62, a presser roller 63 and a driven guide roller 64.

Figure 5:
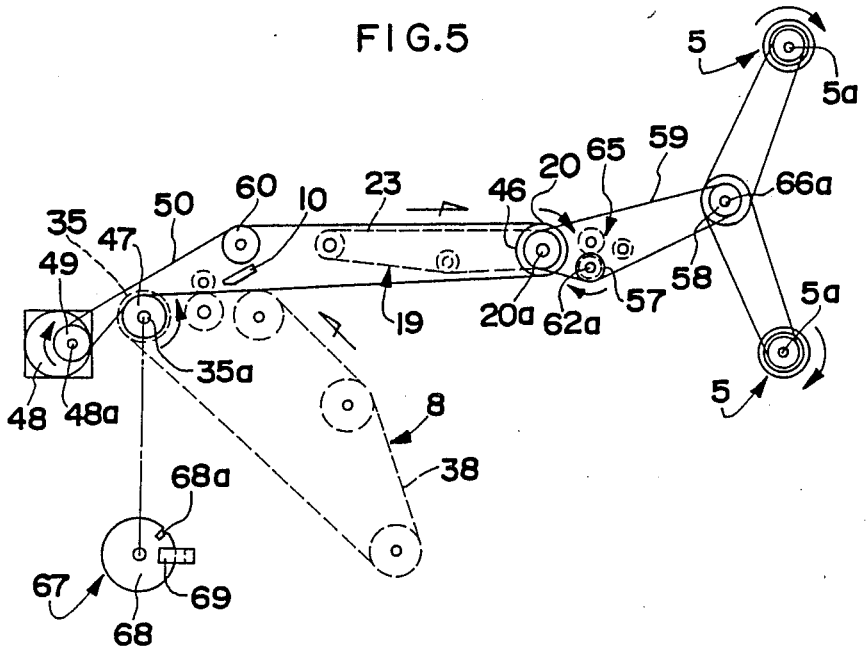
FIG. 5 is a side view of the transmission system.
Figure 6:
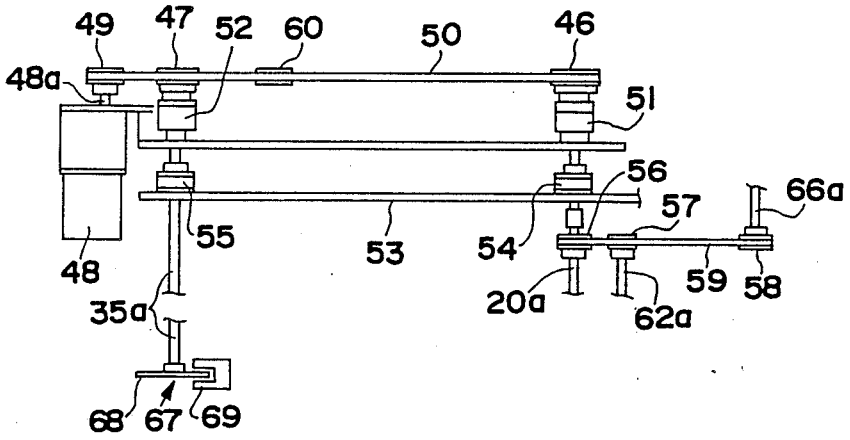
FIG. 6 is a plan view of the transmission system.

As shown in FIG. 5 and FIG. 6, timing pulleys 46, 47 are fixed respectively to the driving shafts 20*a*, 35*a* of the driving toothed sprocket wheel 20 which drives the chain 23 of the said conveying device 19 for the label carrier strip and of the driving toothed sprocket wheel 35 which drives the chain 38 constituting the P 8, and a timing belt 50 is stretched over the timing pulley 49 fixed to the driving shaft 48*a* of the motor 48 and the said timing pulleys 46, 47 in such a way that the timing pulleys 46, 47 may rotate in the direction of arrow indicated int he drawing. Electromagnetic clutches 51, 52 are inserted between he driving shafts 20*a*, 35*a* and the timing pulleys 46, 47 respectively and electromagnetic brakes 54, 55 are also provided between the driving shafts 20*a*, 35*a* and the fixed frame 53 of the machine respectively, as shown in FIG. 6. Moreover, the said driving shaft 20*a* is interlocked with tel driving shaft 62*a* of the driving roller 62 and the driving shaft 66*a* for a winder in the label carrier strip feed device 65 shown in FIG. 4. The driving shaft 62*a* for winder is interlocked with the driving shaft 5*a* of two (upper and lower) winders 5 through an electromagnetic clutch respectively and can selectively drive the two (upper and lower) winders 5. 60 is a driven guide pulley.

A detecting device 67 for label application position onto a post card is linked with the driving toothed sprocket wheel 35 of the chain with feed claws 38 constituting the post card carrier strip conveying route 8 through its driving shaft 35*a* as shown if FIG. 5 and FIG. 6. The number of teeth of the said driving toothed sprocket wheel 35 is decided in such a way that the wheel conveys the post card carrier strip 4 by a length L in the direction of length of the strip of each post card area 4c indicated in FIG. 2 per rotation, while the said detecting device 67 is constituted by a disk 68 fixed to the said driving shaft 35a and having a slit 68a at one point of the periphery and a transmission photoelectric switch 69 which detects the said slit 68a. Therefore, each time when the chain 38 for conveyance of the post card carrier strip turns by the said length L, a detection signal is provided by the photoelectric switch 69 which is turned on with the slit 68a. Moreover, the control circuit of the said motor 48 is constituted in such a way as to stop the motor 48 with the output of the logical sum of the instruction for stop of labelling and the detection signal from the said detecting device 67 (photoelectric switch 69).

Figure 7:
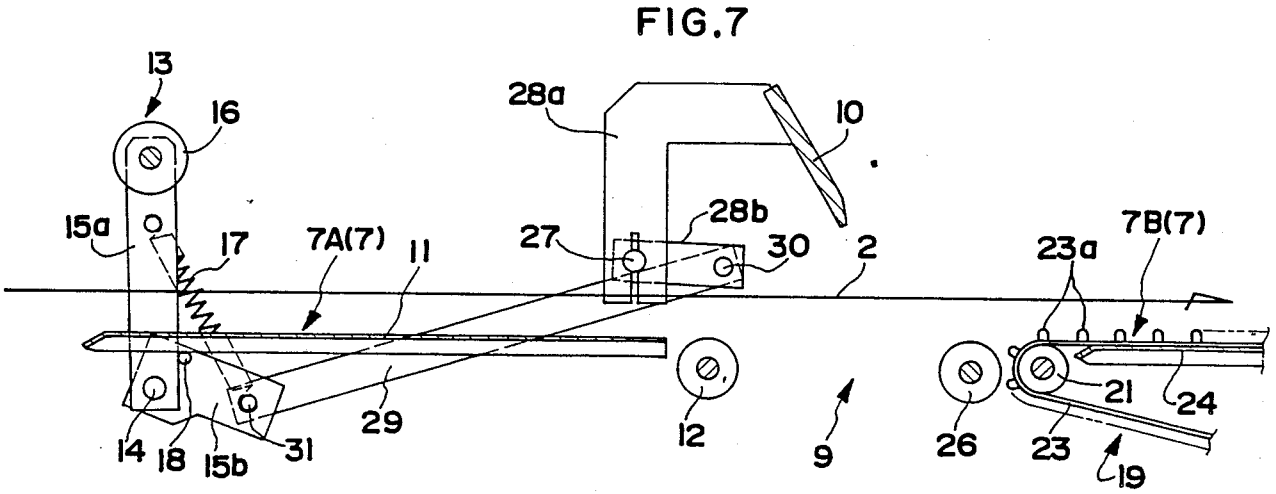
FIG. 7 is a longitudinal schematic sectional view of the conveying route of the label carrier strip as a label is attached to a card.
Figure 9:
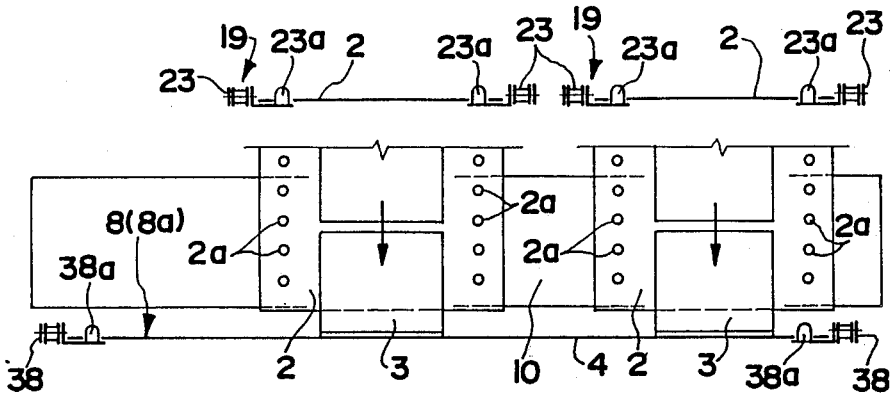
FIG. 9 is a longitudinal elevational view showing the conveyance of the label carrier strip and post card carrier strip, as the labels are peeled off by a turning guide.
Figures 10, 11:
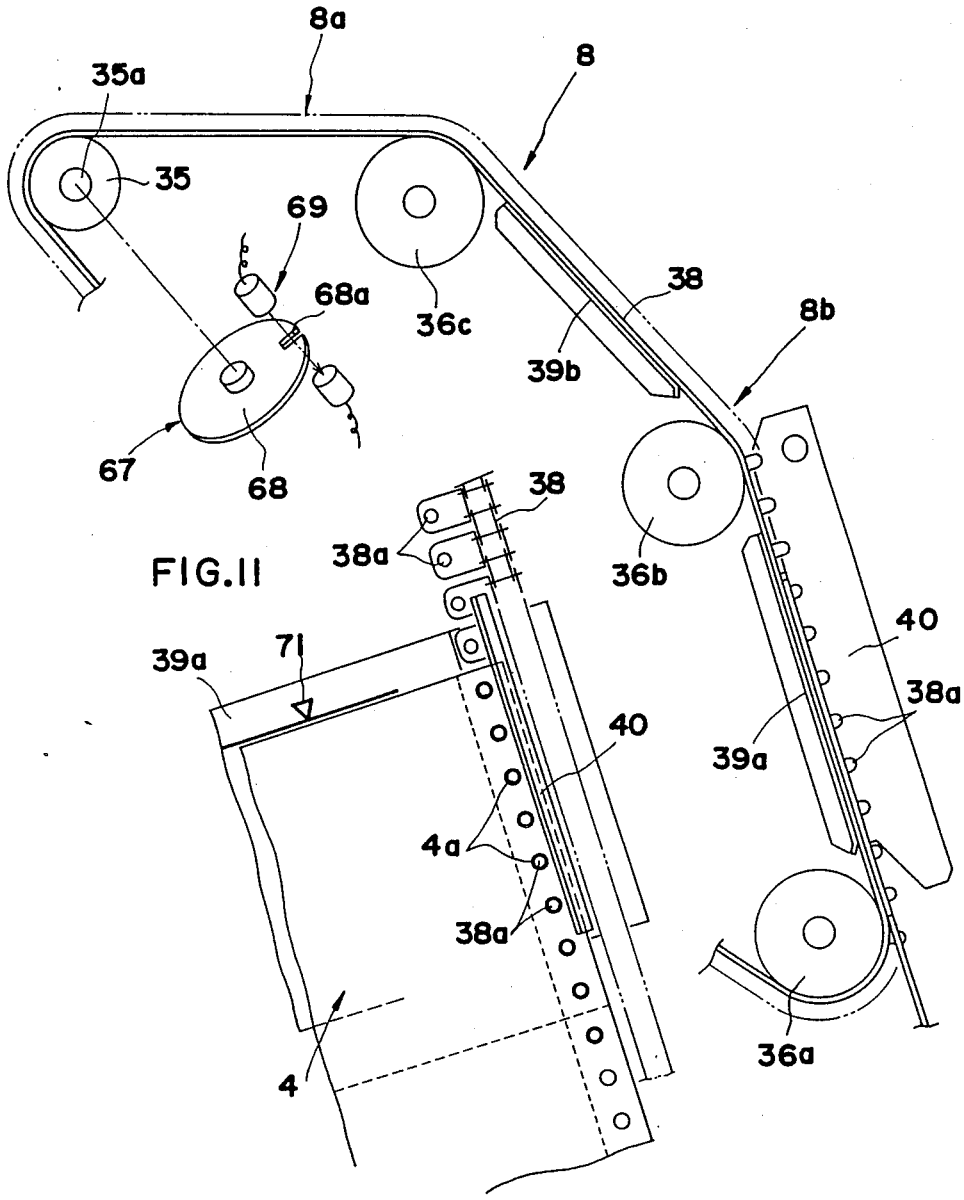
FIG. 10 is a longitudinal schematic sectional view illustrating the attachment of the post card carrying strip.
FIG. 11 is an elevational illustration of the same as in FIG. 10.

Next the attaching method of the label carrier strip 2 on the label conveying route 7 for the label carrier strip is explained. First, turn the driving shaft 27 by 90 degrees in the reverse direction with the motor 34 indicated in FIG. 4 to switch the turning guide 10 to the retiring position by moving it out (upward) of the label conveying route 7 with the first mobile arm 28a as shown in FIG. 7. At the same time, turn the second mobile arm 15b for lifting of braking device in the same direction through the second mobile arm 28b and the interlocking link 29 and turn the first mobile arm 15a upward through the stopper pin 18 to keep the braking roller 16 away upward from the fixed guide plate 11. Under this condition, take out the trip of the label carrier strip 2 with labels loaded at the specified position as shown in FIG. 1, and, with the side provided with labels 3 inside (down), pull it by hand up to the downstream side conveying route portion 7B passing through between the fixed guide plate 11 and the braking roller 16 on the upstream side label conveying route portion 7A of the said label conveying route 7 for label carrier strip and between the opening 9 and the turning guide 10 as shown in FIG. 7. After that, the feed holes 2a are occluded on both side edges of the label carrier strip 2 with the feed claws 23a of the chain with feed claws 23 on the conveying device 19 as shown in FIG. 9 and lower the presser guide 25 indicated in FIG. 4 to set the carrier strip. The label carrier strip 2 is pulled by hand and guided it to either of the upper and lower rolling devices 5 passing through between the driving roller 62 and the presser roller 63 of the feed device 65 for the label carrier strip and under the free guide roller 64 to set the tip of the label carrier strip 2 on that roller device 5.

Next, after locking the driving shaft 20a of the conveying device 19 by means of the electromagnetic brake 54, turn the driving shaft 27 by 90 degrees in the direction of normal rotation by operating the motor 34 of FIG. 4, to lower the turning guide 10 which had taken refuge in the retiring position indicated in FIG. 7 and let drop the braking roller 16 on the fixed guide plate 11 at the same time. As a result, the label carrier strip 2 positioned on the opening 9 is pushed down obliquely by the turning guide 10 as shown in FIG. 4 and makes a detour in the rom of V at the point where it passes from the upstream side label conveying route portion 7A to the downstream side label conveying route portion 7B as illustrated. At this time the label carrier strip 2 is pulled but it never happens that the label carrier strip 2 set on the downstream side label conveying route portion 7B moves backward toward the turning guide 10 with the pulling, because the chain with feed claws 23 of the conveying device 19 is locked by the said electromagnetic brake 54. Moreover, on the upstream side label conveying route portion 7A, the label carrier strip 2 is properly braked by being pressed against the fixed guide plate 11 by the braking roller 16 and, therefore, the label carrier strip 2 is always maintained in a strained condition without loosening downstream of this braking roller 16, namely around the turning guide 10.

The area ranging from the tip of the label carrier strip 2 set on the rolling device 5 to beyond the end of the turning guide 10 on the upstream side becomes a dummy area for attachment and, for that reason, the labels 3 which had been pasted int his area are peeled off prior to their attachment.

Figure 8:
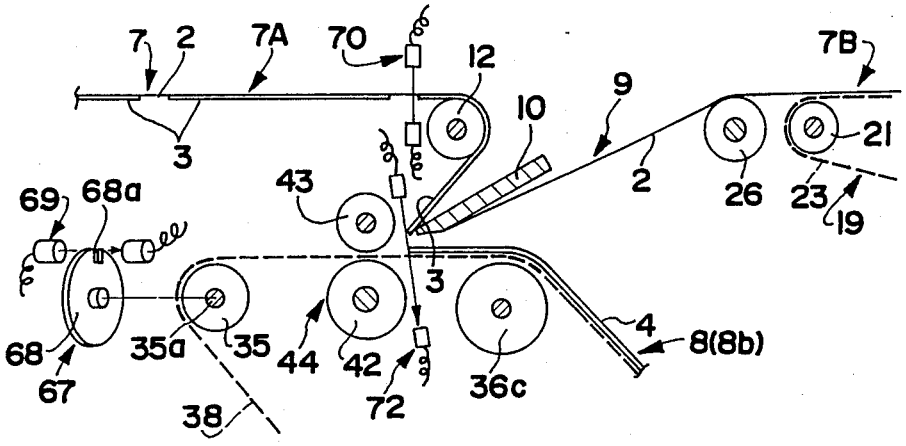
FIG. 8 is a longitudinal schematic sectional view of the principal parts of the apparatus, illustrating the operation of label application and the carrier strip for post cards.

When the attachment of the label carrier strip 2 is over, the applicator head applies the labels 3. Namely, drive the chain with feed claws 23 of the conveying device 19 by releasing the said electromagnetic brake 54 and closing at the same time the electromagnetic clutch 51 only to move the label carrier strip 2 in a way to pull it with the chain with feed claws 23 of the said conveying device 19 and, then the tip of the foremost label 3 pasted o the said label carrier strip 2 has reached the specified position near the tip of the turning guide 10 as shown in FIG. 8, release the electromagnetic clutch 51 to stop the driving of the conveying device 19. A mentioned earlier, the fact that the tip of the foremost label 3 has reached the specified position near the tip of the turning guide 10 can be detected with the running on, at the time of passage of the rear end of the foremost label 3, of the photoelectric switch for label detection 70 disposed in a position corresponding to the rear end of the foremost label which has reached the specified position as shown in FIG. 8, namely the photoelectric switch 70 which is turned on against the thin label carrier strip 2 because its beam passes through it but is turned off against the point of lapping of label 3 and label carrier strip 2 because the beam cannot pass through that point, and the electromagnetic clutch 51 may be released based on this detecting action. At this time the chain with feed claws 23 of the conveying device 19 can be locked as required by closing the electromagnetic brake 54.

Next the setting or a attaching of labels by labelling applying head of the postcard carrier strip 4. Take out the tip of the post card carrier strip 4 loaded in the specified position of the labelling machine as shown in FIG. 1 and, by fitting the tip of the post card carrier strip 4 at a specified position on the post card conveying route 8, for example at the position indicated by the carrier sri end position indicating mark 71 given on the fixed guide plate 39a in the mounting route section 8b, occlude the feed holes 4a of the said post card carrier strip 4 with the feed claws 38a of the chain 38 and bring down in the presser guide 40 to set the sheet. After that, close the electromagnetic clutch 52 indicated in FIG. 6 and, if the electromagnetic clutch 52 indicated in FIG. 6 and, if the electromagnetic brake 55 at the same time to drive the chain 38 for conveyance of the post card carrier strip by transmitting the turning force of the motor 48 to the driving toothed sprocket wheel 35. Before it is driven, the chain 38 for conveyance of the post card carrier strip is stopped in the position when a detecting signal is omitted from the detecting device 67 (position where the photoelectric switch 69 detects the slit 68a of the disk 68) with the functioning of the said detecting device 67 as explained earlier.

When the tip of the post card carrier strip 4 has reached the specified position near the tip of the turning guide 10 as shown in FIG. 8, stop the conveyance of post card carrier strip 4 by chain 38 by releasing the said electromagnetic clutch 52. Namely, since the fact that the tip of the card carrier strip 4 has reached the specified position near the tip of the turning guide as shown in FIG. 8 can be detected by the transmission photoelectric switch 72 which detects the tip of the said post card carrier strip 4, the tip of the continuous sheet for post cards 4 cab be stopped automatically at the specified position near the tip of the turning guide 10 as shown in FIG. 8 by releasing the electromagnetic clutch 52 when the said electromagnetic switch 72 has switched from ON state to OFF state by detecting the tip of the post card carrier strip 4.

The distance from the post card carrier strip 4 end position indicating mark 71 to the detecting position of the said photoelectric switch 72 is fixed equal to a dimension an integral number of items the unit length L in the direction of length of the post card carrier strip for each post card area 4c in the post card carrier strip 4, so that a detecting signal can be obtained also from the said detecting device 67 (photoelectric switch 69) when the said photoelectric switch 72 detected the tip of the carrier strip 4.

If the setting and head application onto the label carrier strip 2 and the post card carrier strip 4 are completed, close the electromagnetic clutches 51, 52 to turn the chain with feed claws 23 provided in the conveying device 19 of the conveying route 7 for the label carrier strip and the chain with feed claws 38 of the post card conveying route 8 at the same speed. As a result, the label carrier strip moves along the label conveying route 7, being pulled by the chain with feed claws 23 of the said conveying device 19, while the post card carrier strip 4 moves at the same speed on the horizontal route section 8a of the post card conveying route 8 in the direction opposite the direction of movement of the said label carrier strip 2.

Thus, when the said label carrier strip 2 turns up obliquely in the form of a V at the tip of the turning guide 10, the label 3, the rigidity of which is larger than that of the label carrier strip 2, moves down obliquely in the direction of extension under the running guide 10 away from the label carrier strip 2 and, in the state of lapping with the post card carrier strip 4 moving in the opposite direction on the horizontal route section 8a of the post card conveying route 8 at the specified position inside each post card area 4c, passes through between the driving roller 42 and the presser roller 43 in the subsequent labelling device 44. In this way, the label 3 peeled from the label carrier strip 2 is automatically pasted on the specified position inside each post card area 4c in the post card carrier strip 4 as indicated by a broken line in FIG. 2.

Since the said conveying device 19 is driven as explained earlier, the rotation of its driving shaft 20a is transmitted to the driving roller 62 of the label carrier strip feed device 65 and to the transmission shaft for winder 66a through the timing pulleys 56 and 58 and the timing belt 59 and, after the labels 3 are peeled off, the label carrier strip 2 carried out by the conveying device 19 is sent out forcibly between the driving roller 62 and the presser roller 63 of the said feed device 65 and passes through under the free guide roller 64, to be automatically rolled by the winder 5 which is set in advance as indicated in FIG. 1.

When interrupting the labelling work, the motor 48 is stopped with the output of the logical use of the stop command for that interruption and the detecting signal of the said detecting device 67 (photoelectric switch 69) for head application to post card sheet and, if necessary, the driving shafts 20a, 35a are also braked with the electromagnetic brakes 54, 55 at the same time. Therefore, the label carrier strip 2 and the post card carrier strip 4 always stop in the state where the tip of the label 3 to be pasted next shows at the specified position near the tip of the turning guide 10 (condition in which the photoelectric switch 70 for label detection detects the rear end of the label 3 concerned) and also in the state where the front end of the post card area 4c on which to paste the label 3 next (position for perforation 4b for separation) is found in the detecting position of the photoelectric switch 72 for detection of end of post card carrier strip, and it never happens that they stop while the label 3 is being pasted on the post card carrier strip 4.

Consequently, at this state of interruption of labelling work, it is possible to release the electromagnetic clutch 51, release the electromagnetic brake 54 if it is working and make a positional adjustment of the label 3 as required by moving the label carrier strip 2 forward and backward together with the chain with feed claws 23 of the conveying device 19 or release the electromagnetic clutch 52, release the electromagnetic brake 55 if it is working and make positional adjustment of the post card are 4c by moving the post card carrier strip 4 forward and backward together with the chain with feed claws 38a which is the means of conveyance. Moreover, even when the post card carrier strip 4 is moved forward or backward together with feed claws 38a which is the means of conveyance as mentioned hereinabove, the front end position of the post card area 4c located on the way of the post card carrier strip 4 which is undetectable with the photoelectric switch 72 can be detected with the detecting signal of the said detecting device 67 for head application to post card carrier strip (photoelectric switch 69), and the head application to the post card area 4c found on the way of the post card carrier strip 4 can be performed automatically. In the example the system is constructed by interlocking the turning guide 10 and the braking device 13 with each other so that the braking device 13 may go up and down automatically following the ascent and the descent of the turning guide 10. However, it may also be constructed in a way to raise and lower the braking device manually. Moreover, the braking device 13 can be of any suitable construction such as rubber plate, etc., instead of the braking roller 16 which is used in the example.

Figure 12:
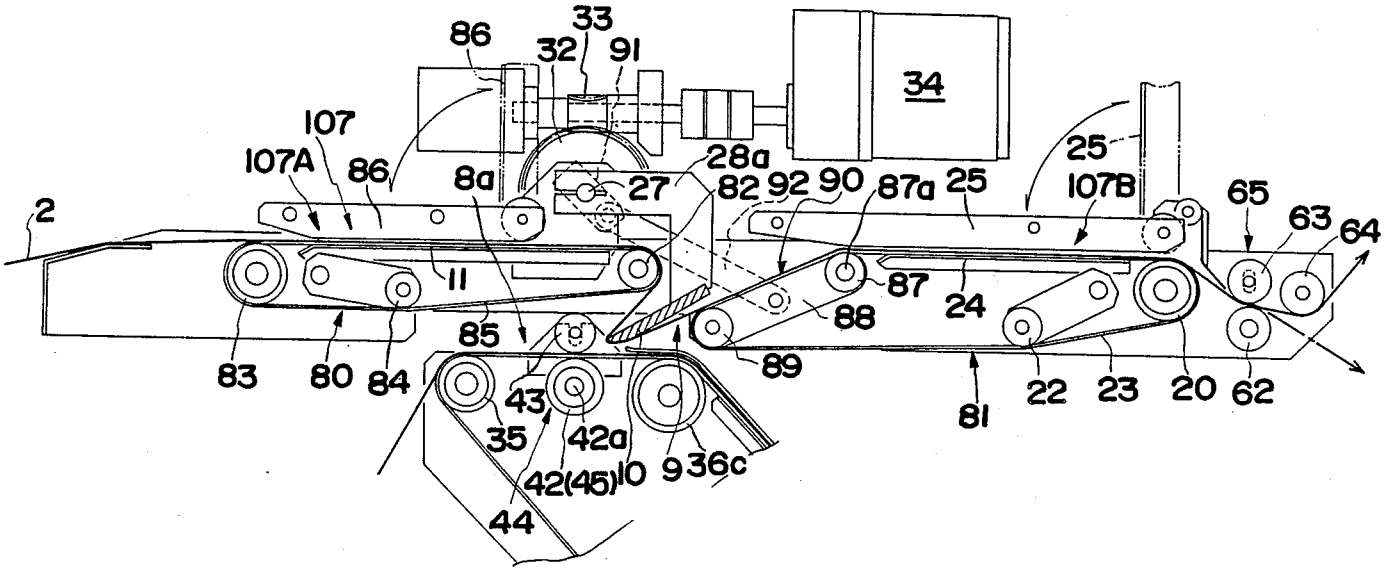
FIGS. 12–15 illustrate another embodiment of the present invention.

FIG. 12 to FIG. 15 show another embodiment of the present invention. This embodiment is explained by indicating the differences from the aforementioned embodiment but omit explanation on the component parts which are identical with those in the aforementioned example, but just furnishing them with the same reference numbers as those used in the aforementioned embodiment. In this embodiment, the upstream side conveying route portion 107A and downstream side conveying route portion 107B of the conveying route 107 for the label carrier strip are constituted by an upstream side conveying device 80 and a downstream side conveying device 81 respectively as shown in FIG. 12.

The upstream side conveying device 80 has a pair of (left and right) chains with feed claws (feed claws are not indicated in the drawing), which are stretched between a driving toothed sprocket wheel 82 and a driven toothed sprocket wheel 83 and given a proper tension by a mobile toothed sprocket wheel for tensioner 84, a fixed guide plate 11 and a freely rising and falling presser guide 86.

The said downstream side conveying device 81 has a pari of (left and right) chains with feed claws 23 (feed claws are not indicated in the drawing), which are stretched on a driving toothed sprocket wheel 20, an intermediate driven toothed sprocket wheel 87 and a driven toothed sprocket wheel 89 supported by shaft at the free end of a mobile arm 88 swingable vertically centering around the bearing shaft 87*a* of this intermediate drived toothed sprocket wheel 87 and given a proper tension by a mobile toothed sprocket wheel for tensioner 22, a fixed guide plate 24 and a freely rising and falling presser guide 25, and, with an up-down swinging of the said mobile arm 88, can be switched between a horizontal posture constituting part of the said conveying route 107 for the label carrier strip and an inclined posture slanting down obliquely.

The turning guide 10 for the label carrier strip is mounted horizontal in the transversal direction at the end of the vertically swingable first mobile arm 28*a* one end of which is fixed to the horizontal driving shaft 27 disposed in the transversal direction, and the second mobile arm 91 fixed to the said driving shaft 27 and the mobile arm 88 in the said downstream side conveying device 81 are linked with each other through an interlocking link 92. A worm wheel 32 is fixed to the said driving shaft 27, and a worm gear 33 occluding with this worm wheel is designed to be rotatable in both normal and reverse directions as desired by means of a motor 34.

Therefore, if the said motor 23 rotates the driving shaft 27 in the normal direction (clockwise direction in FIG. 12) through the worm gear 33 and the worm gear 33 and the worm wheel 32, the mobile arm 88 in the said downstream side conveying device 81 turns downward through the second mobile arm 91 and the interlocking link 92, and the starting end 90 of conveying route of the said downstream side conveying device 81 switches to the inclined posture indicating in FIG. 12. At the same time, the turning guide 10 passes obliquely in the upstream direction to the inside (lower part) of the label conveying route 107 for the label carrier strip through the opening 9 which has been widened with the switching to inclined posture of this starting end 90 of conveying route, to be switched to the label peeling position.

Figure 13:
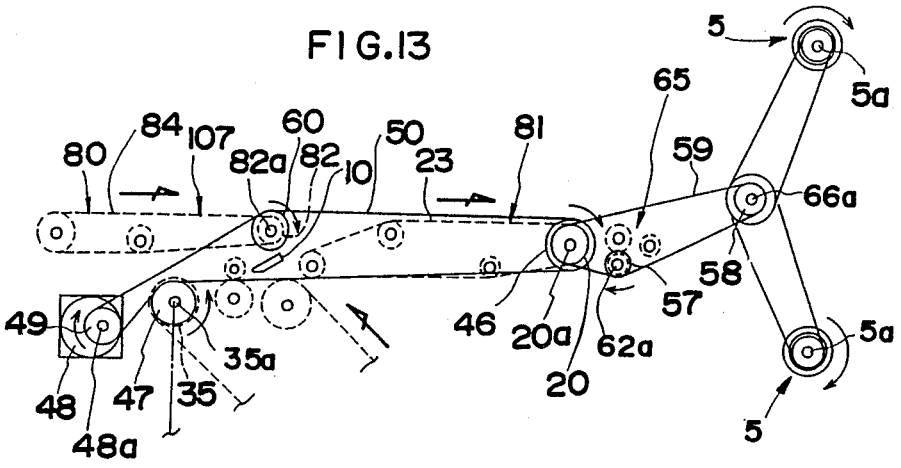
Figure 14:
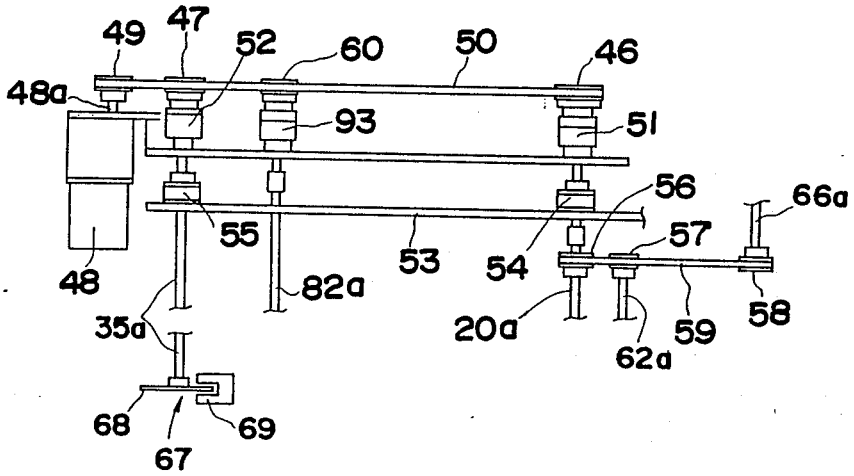

As shown in FIG. 13 and FIG. 14, timing pulleys 60, 46, 47 are fixed respectively to the driving shafts 82*a*, 20*a*, 35*a* of the driving toothed sprocket wheels 82, 20 which drive chains 85, 23 of the two conveying devices 80, 81 constituting the said label conveying route 107 for the label carrier strip and of the driving toothed sprocket wheel 35 which drives the chain 38 constituting the post card conveying route 8, and a timing belt 50 is stretched over the motor 48 and the said timing pulleys 60, 46, 47, in such a way that the timing pulleys 60, 46, 47 may rotate in the direction of arrow indicated in the drawing. Electromagnetic clutches 93, 51, 52 are inserted between the driving shafts 82*a*, 20*a*, 35*a* and the timing pulleys 60, 46, 47 respectively and electromagnetic brakes 56, 57 are also provided between the driving shafts 82*a*, 20*a*, 35*a* and the fixed frame 53 of the machine respectively, as shown in FIG. 14. Of the said electromagnetic clutches 93, 51, 52 the electromagnetic clutches 93, 51 are so-called one-position clutches which, if put under voltage, are connected with each other to get in the conductive state only when one fixed point of the transmitter side and one fixed point on the receiver side agree with other.

Figure 15:
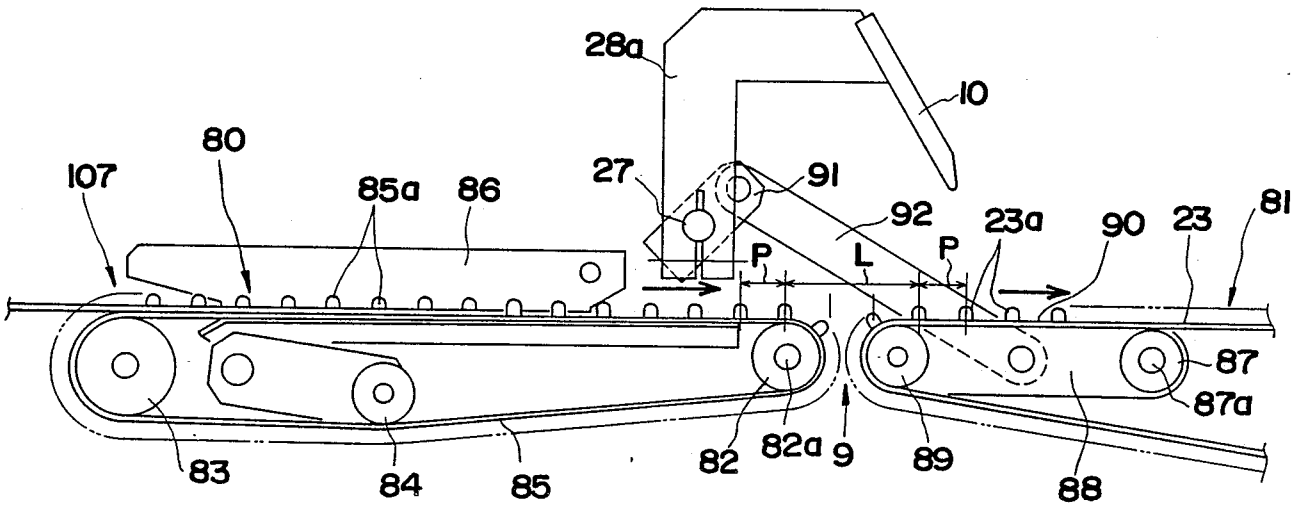

Next, the setting method of the label carrier strip 2 on the conveying route 107 for the strip, is planed. First, turn the driving shaft 27 by 90 degrees in the reverse direction with the motor 34 indicated in FIG. 12 to switch the turning guide 10 to the retiring position by moving it to the outside (upward) of the conveying route 107 with the first mobile arm 28*a* as shown in FIG. 15. At the same time, make the mobile arm 88 in the downstream side conveying device 81 goes up to switch the starting end 90 of conveying route to a horizontal posture. Under this condition, take out the tip of the label carrier strip 2 with labels loaded at the specified position as shown in FIG. 1 and, with the side provided with labels 3 inside (down), occlude the feed holes 2*a* on the both side edges with the feed claws 85*a* of the chain with a pair of (left and right) feed claws 85 in the upstream side conveying device 80 of the said label conveying route 107 for the label carrier strip, and lower the presser guide 86 to set the ground paper.

After that, operate the motor 48 indicated in FIG. 13 and FIG. 14 and close the electromagnetic clutches 93, 51 to rotate the driving toothed sprocket wheels 82, 20 in the conveying devices 80, 81 of the label conveying route 107 for the label carrier strip and make the respective chains with feed claws 85, 23 turn in the same direction. Since the said electromagnetic clutches 93, 51 are one-position clutches as mentioned earlier, if those clutches 93, 51 are so adjusted that they both are switched to the transmitting state when the distance L between the feed claw 85*a* of the upstream side conveying device 80 and the feed claw 23*a* of the downstream side conveying device 81 becomes equal to a dimension an integral number of times as long as the pitch p of the feed claws 85*a*, 23*a* in the two conveying device 80, 81, the feed holes 2*a* of the label carrier strip 2 conveyed by the turning chain with feed claws 85 of the upstream side conveying device 80 automatically occlude with the feed claws 23*a* of the chain 23 in the downstream side conveying device 81 when this label carrier strip 2 moved onto the downstream side conveying device 81 through the opening 9, thus taking over the feed action of this downstream side conveying device 81.

If the tip of the label carrier strip 2 has been conveyed to the terminal position of the downstream side conveying device 81 as described hereinabove, the electromagnetic clutches 93, 51 are released to stop the driving of the both conveying device 80, 81 and make the chains with feed claws, 23 free. Under this condition, pull the label carrier strip 2 by hand, guide it to either of the upper and lower rolling devices 5 passing through between the driving roller 62 of the label carrier strip feed device 65 and the presser roller 63 and under the free guide roller 64, and set the end of the label carrier strip 2 on that roller device 5. At this time, lower the presser guide 25 of the downstream side conveying device 81 to the set position.

Next, after locking the driving shaft 20*a* of the downstream side conveying device 81 by means of the electromagnetic brake 54, turn the driving shaft 27 by 90 degrees in the direction of normal rotation by operating the motor 34 of FIG. 12 to lower the turning guide 12 which had taken refuge in the retiring position indicated in FIG. 15 and move the starting end 90 of conveying route of the downstream side conveying device 81 downward from a horizontal posture. As a result, the starting end 90 of conveying route of the downstream side conveying device 81 is switched to an included posture, and the turning guide 10 goes down obliquely to the upstream direction through the widened opening 9 to be switched to the label peeling position. Therefore, the label carrier strip 2 position on the opening 9 is pushed down obliquely by the turning guide 10 and makes a detour in the form of V at the point where it passes from the upstream side conveying device 80 to the downstream side conveying device 81 as illustrated. At this time, the label carrier strip 2 is pulled but it never happens that the label carrier strip 2 set on the downstream side conveying device 81 moves backward toward the turning guide 10 with the pulling, because the chain with feed claws 85 of the upstream side conveying device 80 is free and the chain with feed claws 23 of the downstream side conveying device 81 is locked by the said electromagnetic brake 54.

The upstream side conveying device 80 is driven only at the time of application of the label carrier strip 2 and is just running in the free state following the movement of the label carrier strip 2.

According to the examples of the present invention which have so far been explained fairly in detail, the present invention has the following effects:

(1) The label conveying device is simplified in structure because it may be provided only in the downstream side conveying route.

(2) When providing a label conveying device in both the upstream side conveying route and the downstream side conveying route, the application of the label carrier strip with labels is easy because all one has to do is to just connect the label carrier strip to the upstream side conveying route. f (3) By providing, in the upstream side conveying route, a braking device which presses the label carrier strip under conveyance to brake its movement, it is possible to maintain the label carrier strip, which is conveyed by the downstream side conveying device, always in a strained condition and perform the peeling and the pasting of the labels correctly and smoothly.

(4) The application of the label carrier strip is easy with no obstacle on the label conveying route of the label carrier strip, because the braking device is so designed as to be opened upward from the braking position synchronizing with the movement to the retiring position of the turning guide of the label carrier strip.

(5) The braking device can brake the label carrier strip securely because it is designed to not only return to the braking position synchronizing with the return to the pasting position of the turning guide of label carrier strip but also be pushed to the label carrier strip side with a power spring which is not under the control of the movement of the said turning guide.

(6) Since the starting end of the conveying route of the downstream side conveying device is provided in such a way as to incline obliquely from the straight line on the upstream side label conveying route synchronizing with the movement of the turning guide of band-shaped ground paper, it not only facilitates the application of label carrier strip by making the downstream stream side label conveying route come close to the upstream side conveying route when the turning guide of the label carrier strip is in the retiring position but also makes it impossible for the turning guide of the label carrier strip to move to the pasting position smoothly by widening the opening between the upstream side conveying route and the downstream side conveying route in parallel with the downward oblique movement of the starting end of the label conveying route.

(7) The labels can be pasted correctly in the fitting position of the post card or other object material because the system is so designed as to synchronize the actions of the said two conveying devices by means of the detection signals of a label end position detecting device provided inthe label conveying device as well as the post card end position detecting device and a labelling position detecting device provided in the post card conveying device.

(8) The application to the post card is easy because all one has to do is to set the post card in the post card conveying device in such a way as to fit the end of the post card to the post card end position indicating mark provided int hat post card conveying device.

(9) Detecting products are only very rarely produced because, even if when the labelling work is interrupted, the label and the labelling area of the post card always stop in the state that are relatively positioned at the end of the turning guide but never stop on the way of labelling.

I claim:

1. A labelling machine comprising a label conveying device which is adapted to carry substantially linearly in the direction of travel a label carrier strip provided with detachable labels at regular intervals, a post card conveying device located under the said label conveying device and which carries, in the direction opposite to the said direction of conveyance of labels, a post card carrier strip having post cards thereon onto which post cards the said labels are to be attached, and a label attaching device for automatically attaching to a post card, in the attaching position, the labels which are conveyed by the said label conveying device, wherein said label conveying device has a label conveying route comprised of an upstream side conveying route, and a downstream side conveying route, and a turning guide for said label carrier strip, said turning guide being adapted to move between a retiring position above the label conveying route and said attaching position close to the post card conveying device through an opening provided between said upstream side and said downstream side conveying routes.

2. The labeling machine of claim 1, wherein said upstream cycling route is provided with a braking device for braking the carrier strip in a stretched position during the conveyance thereof.

3. The labeling machine of claim 2, wherein the braking device is adapted to open upward from the carrier strip when said turning guide is in the retiring position, and brakes the carrier strip when said turning guide is in the attaching position.

4. The labeling machine of claim 2, wherein said braking device comprises a braking roller, a first supporting shaft for rotatably supporting said braking roller, a mobile arm for mounting said first supporting shaft, a second supporting shaft for holding said mobile arm in a vertically swingable manner, and a pushing device for pressing said second supporting shaft against the carrier strip.

5. The labelling machine of claim 4, wherein said mobile arm is a first mobile arm, further comprising a second mobile arm pivoted adjustably from said first mobile arm, interlocking link for linking said second mobile arm and said turning guide, a spring disposed between said first and said second mobile arms, and a stopper on said second mobile arm for enabling the first mobile arm to move jointly with the second mobile arm at the time of opening of the braking roller.

6. The labelling machine of claim 1, wherein said label conveying device is provided both in the upstream side and the downstream side conveying routes with a driving shaft driven by a common driving source.

7. The labelling machine of claim 6, wherein the beginning in the direction of the travel of the label carrying strip of the downstream side conveying device inclines obliquely downward.

8. The labelling machine of claim 6, wherein the starting portion in the direction of travel of the label carrying strip, of the conveying route of the downstream side conveying device is adapted to incline depending on the position of said turning guide, whereby said starting end comprises a straight extension of the upstream side conveying route when the turning guide is in the retiring position, and said starting end is inclined downward when said turning guide is in the attaching position.

9. The labelling machine of claim 1, further comprising a driving roller and presser roller facing said driving roller.

10. The labelling machine of claim 9, wherein a label peeled off from the label carrying strip is adapted to make a U-shaped detour to the inside of the upstream side conveying route, and when said label overlaps a post card, said driving roller and presser roller are adapted to attach that label to said post card.

11. The labelling machine of claim 1, wherein said label conveying device further comprises a label end position detecting device for detecting the arrival of one end of a label at said turning guide in said attaching position.

12. The labelling machine of claim 1, wherein said post card conveying device further comprises a labeling position detecting device for detecting a conveying position each time when said post card carrier strip travels a distance corresponding to the length of a label.

13. The labelling machine of claim 12, wherein said labelling position detecting device is adapted to stop the movement of said label carrier strip and said post card carrier strip when detecting the end of a label.

14. The labelling machine of claim 1, wherein said post card conveying device includes a detecting device for detecting the arrival of a post card at the edge of said turning guide.

15. The labelling machine of claim 1, wherein said post card conveying device is provided with an indicating mark for indicating the end position of a post card.

16. The labelling machine of claim 15, wherein the distance between said indicating mark to the position detected by said labelling position detecting device is a cardinal number multiple of the length of the area on the post card to which a label is to be applied.

* * * * *